US012228314B1

(12) United States Patent
Woods

(10) Patent No.: US 12,228,314 B1
(45) Date of Patent: Feb. 18, 2025

(54) CASCADING THERMOELECTRIC HEAT PUMP

(71) Applicant: The United States of America, as represented by the Secretary of the Navy, Arlington, VA (US)

(72) Inventor: Kevin Woods, Downingtown, PA (US)

(73) Assignee: The United States of America, as represented by the Secretary of the Navy, Arlington, VA (US)

( * ) Notice: Subject to any disclaimer, the term of this patent is extended or adjusted under 35 U.S.C. 154(b) by 151 days.

(21) Appl. No.: 17/661,551

(22) Filed: Apr. 30, 2022

Related U.S. Application Data

(60) Provisional application No. 63/264,683, filed on Nov. 30, 2021.

(51) Int. Cl.
*F25B 30/02* (2006.01)
*F25B 21/02* (2006.01)

(52) U.S. Cl.
CPC ..... *F25B 30/02* (2013.01); *F25B 21/02* (2013.01); *F25B 2321/023* (2013.01); *F25B 2321/0252* (2013.01)

(58) Field of Classification Search
CPC .... F25B 30/02; F25B 21/02; F25B 2321/023; F25B 2321/0252
See application file for complete search history.

(56) References Cited

U.S. PATENT DOCUMENTS

| | | | | |
|---|---|---|---|---|
| 10,260,781 | B2 * | 4/2019 | Lin | F25B 21/02 |
| 2009/0249796 | A1 * | 10/2009 | Ullman | F25B 21/02 62/3.7 |
| 2018/0031285 | A1 * | 2/2018 | Thomas | F25B 21/04 |

* cited by examiner

*Primary Examiner* — Ana M Vazquez
(74) *Attorney, Agent, or Firm* — Mark J. Rosen

(57) ABSTRACT

A cascading thermoelectric heat pump employs a stack of cold plates with a series of thermoelectric coolers sandwiched between each adjacent pair of cold plates, allowing for noise-free cooling and heating of a 67° F. water supply, capable of delivering water chilled to about 44° F. and water heated to about 90° F.

7 Claims, 10 Drawing Sheets

Cool
Hot
Cool
Hot
Cool
Hot

CASCADING THERMOELECTRIC HEAT PUMP

STATEMENT OF GOVERNMENT INTEREST

The invention described herein may be manufactured and used by or for the Government of the United States of America for governmental purposes without payment of any royalties thereon or therefor.

FIELD OF THE INVENTION

The invention is related to the field of thermoelectric heat pumps.

BACKGROUND OF THE INVENTION

Naval vessel heat exchangers typically require and use chilled water at about 44° F. for a variety of operational requirements. The standard Navy chilled water system temperature of 44° F. is aimed primarily at dehumidification for air conditioned spaces. Electronics, however, generally require a temperature closer to 67° F. for peak performance, as they are adversely impacted by condensation which would be present using colder chill temperatures. Therefore, cooling equipment units (CEUs) are deployed on naval vessels to raise the temperature of electronic system cooling water to between 67° F. to 73° F. Such CEUs are provisioned for sonar, radar, command and decision units, and other electronics.

The Navy is transitioning to electric drive, and utilizing propulsion power to boost available shipboard power. This leads to a two to three times increase in the available shipboard power aimed at high power electronics, weapons, and sensors. Legacy platform chilled water loads are used in the range of less than 25% for electronics and greater than 75% for air conditioning. Next generation platform chilled water systems see an increase in demand, trending towards greater than 50% for cooling electronics.

A chilled water system designed for operation at 67° F. is significantly more efficient than one designed for operation at 44° F. The increase in operating temperature nearly doubles the cooling capacity of an air conditioning plant (chiller) with the same size, weight, and power (SWaP) footprint. Legacy 44° F. air conditioning heat exchangers, however, are incapable of operation using 67° F. water.

The art is in need of improved heat pumps with advantages over, and without the disadvantages of, conventional designs.

SUMMARY OF THE INVENTION

The inventor hereof provides a low hazard cascading thermoelectric heat pump doubling the existing chilled water supply compared to legacy Navy platforms by designing the chilled water system as a two stage structure. The invention can reduce higher temperature chilled water (such as at 67° F.) down to 44° F. at the point of use before entering a heat exchanger for uses such as air conditioning. The device is activated only when cooling is required from the heat exchanger making the total power use for the ship significantly less. In addition, the device enables heating for spaces—the heat pump may operate in the opposite direction saving the power used for space heating during winter months or in colder climates such as Arctic conditions. The purpose of the device is to enable naval vessels to change their reliance on a 44° F. chilled water temperature supply to a higher temperature chilled water system, thereby saving significant energy in the process.

The invention provides an on-demand reliable heat pump that poses little hazard to ships. In one aspect, the invention uses a water supply at about 67° F., ideal for cooling electronics, and chills the water supply using a series of thermoelectric cooling devices to decrease the 67° F. water to 44° F. for air conditioning heat exchangers. The heat pump has the added advantage of saving energy when air conditioning is not needed and offsets the power use by heaters during winter conditions by running the heat pump in the opposite direction to heat the chilled water from 67° F. to about 90° F.

In one aspect, then, the invention is directed to a cascading thermoelectric heat pump having a stack of at least four thermally conductive cold plates, each cold plate in the stack being alternatingly a cool cold plate or a hot cold plate, the cold plates having at least two channels and at least one tube for carrying fluid looping through the channels, the tube having an inflow end and an outflow end. A plurality of electrically connected thermoelectric coolers situate between each respective pair of cold plates. Fluid may stream through the heat pump via an inflowing cool conduit connected to the inflow ends of the tubes of the cool cold plates and an outflowing cool conduit connected to the outflow ends of the tubes in the cool cold plates, and an inflowing hot conduit connected to the inflow ends of the tubes in the hot cold plates and an outflowing hot conduit connected to the outflow ends of the tubes in the hot cold plates. When electricity is supplied to the thermoelectric coolers, a cool supply stream of fluid supplied to the inflowing cool conduit is cooled by passage through the stack of cold plates, and a hot supply stream of fluid supplied to the inflowing hot conduit is heated by passage through the stack of cold plates. In another aspect, each of the cold plates has an upper side with an upper channel and a lower side with a lower channel; and the tube enters the cold plate through the upper channel in the upper side, loops around to return anti-parallel in the lower channel in the lower side, whence it exits the cold plate.

In another aspect, the cold plates have a slit capable of inhibiting heat exchange between the upper side and the lower side of the cold plates, the slit being parallel to the channels and the tube, the slit extending from a proximal edge of the cold plates where the tubes enter and exit, and the slit extending at least halfway through to a distal edge of the cold plate. In another aspect, the thermoelectric coolers are arranged in two rows, an upper row on the upper sides of the cold plates and a lower row on the lower sides of the cold plates. The upper row and the lower row each may have at least eight thermoelectric coolers, although they may have more, such as twelve each, sixteen each, or more. In one aspect, the stack of cold plates has at least eight cold plates, but may be more, such as twelve, sixteen, or even more. The fluid is typically water but other fluids may be used. In one aspect, the heat pump is capable of generating a temperature difference of at least 10° F., or at least 20° F., or at least 25° F. In another aspect, the heat pump is capable of chilling water from an inflowing temperature of about 67° F. to an outflowing temperature of about 44° F., and/or heating water from an inflowing temperature of about 67° F. to an outflowing temperature of about 90° F. In one aspect, the cascading thermoelectric heat pump has sixteen cold plates and 32 thermoelectric coolers arranged in two rows situate between each pair of adjacent cold plates. In another aspect, the cold plates are McMaster Carr 35035K42 cold plates having copper tubes, and the thermoelectric coolers are Marlow TR060-6.5-040 thermoelectric coolers.

These and other aspects of the invention will be readily appreciated by those of skill in the art from the description of the invention herein.

DETAILED DESCRIPTION OF THE INVENTION

A thermoelectric cooler (TEC) device utilizes electric power to cause a thermal gradient across the device causing one side to become cold and the other hot. Solid-state TECs operate in accordance with the Peltier effect, creating a temperature difference by transferring heat between two electrical junctions. When a voltage is applied across joined conductors, an electric current is generated, which flows through the junctions of the two conductors. Heat is thereby removed at one junction, resulting in cooling, while the heat is deposited at the other junction, resulting in heating.

TEC devices are relatively high in cost relative to cooling capacity, and they have relatively low power efficiency, i.e., a low coefficient of performance (COP). But TECs have no moving parts, conferring durability and resistance to stress, as well as enjoying a long lifespan. They generally do not rely on circulating liquid as used in conventional heat exchange units, and thus are not prone to leaks or potentially hazardous refrigerant liquids. TECs are also generally small in size, and adaptable in shape.

Figure 1:
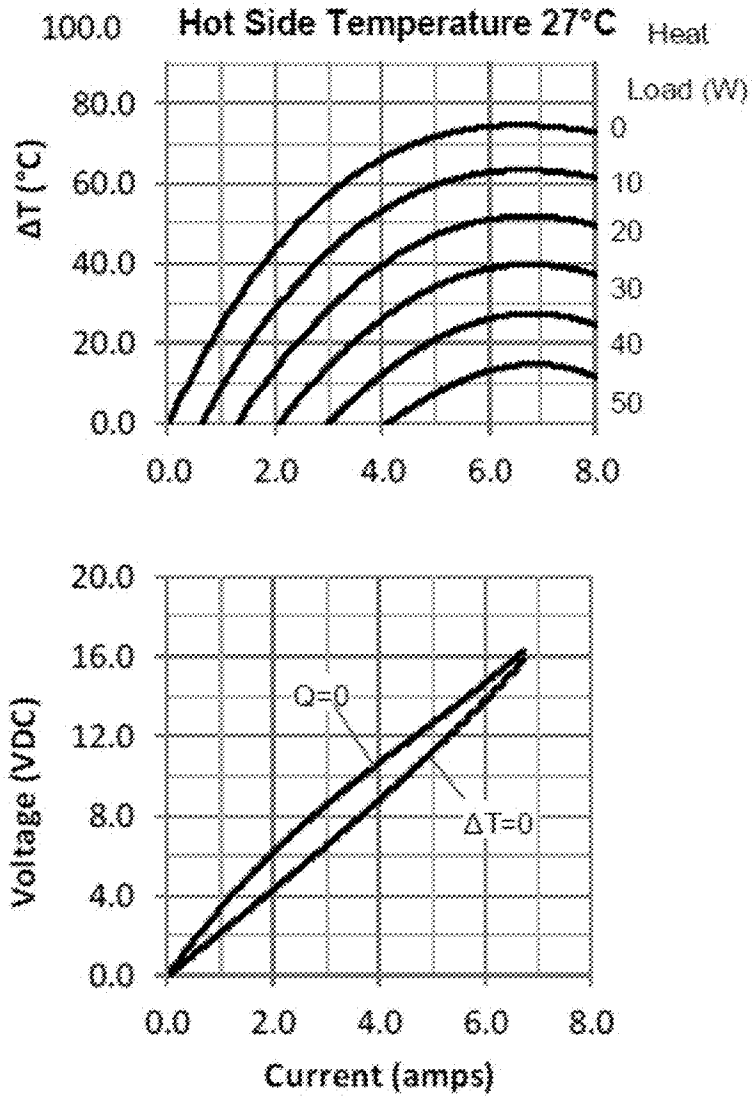
FIG. 1 shows the specification relationship between temperature difference, current and voltage, and heat flow for one particular TEC module usable in the invention.

The temperature performance of a TEC varies with voltage, current, and heat flow, and different embodiments of the invention may utilize different TECs depending on the desired specifications and characteristics. In some embodiments, for example, a Marlow TR060-6.5-040 single-stage thermoelectric cooler (Marlow TEC) may be used. Such a Marlow TEC physically measures about a 1.5 inch square with one edge extended for electrical connections, and with a thickness of about 4 mm. The temperature difference versus current and heat flow from this particular Marlow TEC is shown in FIG. 1, drawn from its Technical Data Sheet. The temperature difference (ΔT) reflects the difference between the device's hot side temperature and its cold side temperature. While the Marlow TEC is just one example of TEC modules useful in the heat pump of the invention, those of skill in the art will understand that many other TECs available on the market would be as easily useful in the invention.

The performance of a TEC may be characterized by the following equation $$\Delta T=75-1.15Q-1.78(6.5-I)^2$$

where ΔT is the temperature difference in ° C., I is the electrical current in amps, and Q is the heat flow in watts.

Rearranging the equation to determine heat load based on temperature difference produces:

$$Q=65.2-0.87\Delta T-1.55(6.5-I)^2$$

Figure 2:
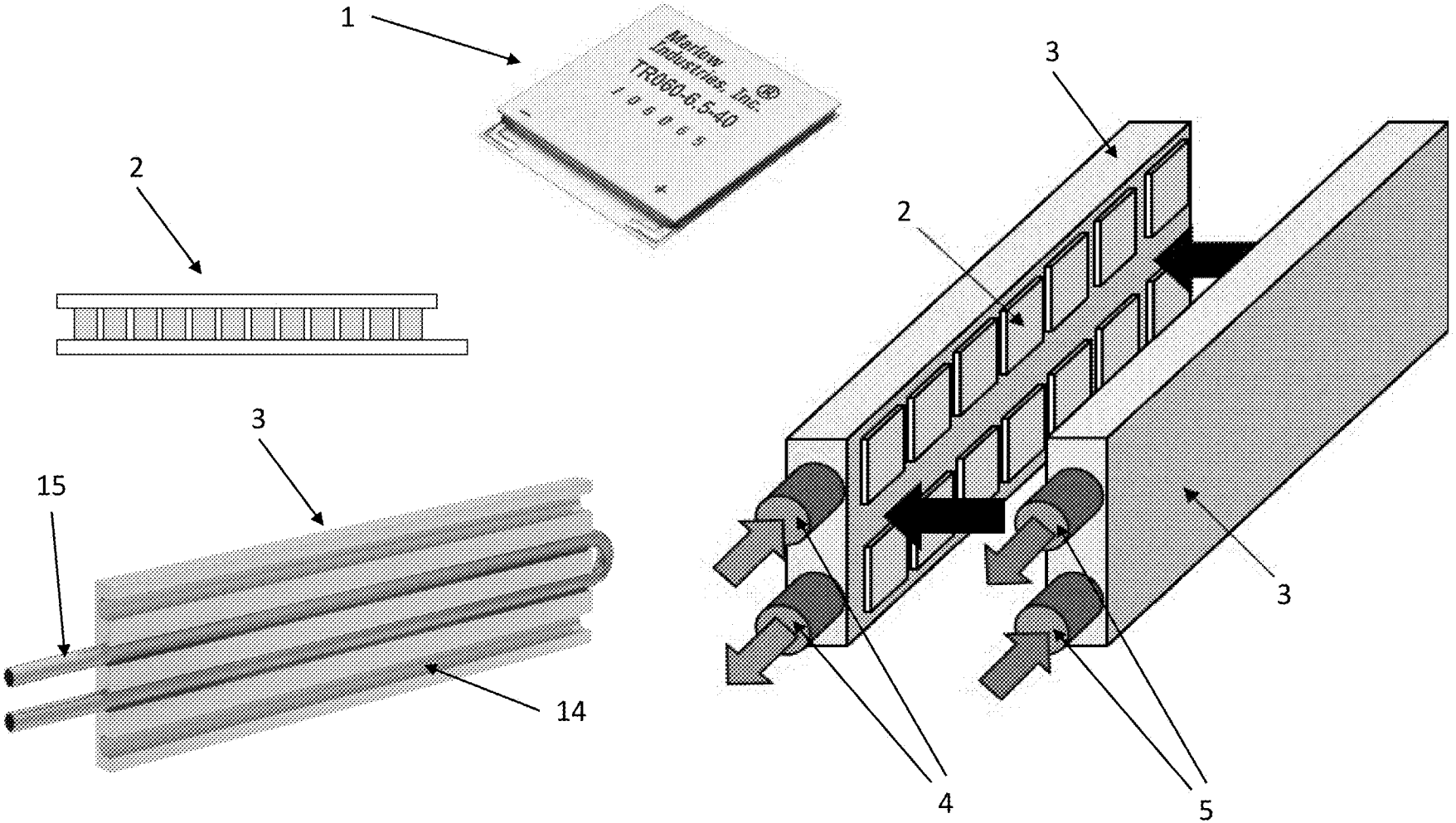
FIG. 2 depicts two different perspective views of a TEC module, and one perspective view of two cold plates with TECs sandwiched between them.

FIG. 2 shows a Marlow TEC 1, and a schematic side view of a TEC 2, where the heat load is transferred from the cold side to the hot side in response to electrical current flow in the thermoelectric material. Multiple TECs 2 (which may be Marlow TECs 1 or other TECs) are placed sandwiched between thermally conductive cold plates 3. The TECs are electrically connected such that an electric current may be delivered to all the TECs simultaneously. Cold plates 3 have channels 14 running through them, in which tubes may be situated for carrying fluid streams. In FIG. 2, one such cold plate is shown with a copper tube 15 looping therethrough. Cold plates 3 permit fluid streams to pass through tubes 15 therein and thereby exchange heat. As shown in FIG. 2, for example, one cold plate 3 has cooler supply water 4 being cooled by the cold side of the TECs 2, and the other cold plate 3 has warmer return water 5 being heated by the hot side of the TECs 2.

The voltage for the Marlow TEC is equal to V=2.5/and the power is P=2.512. The coefficient of performance (COPTEC) of a single thermoelectric cooler is given by the following equation and shown in FIG. 4.

$$COP_{TEC}=\frac{Q_{TEC}}{P_{TEC}}=\frac{65.2-0.87\Delta T-1.55(6.5-I)^2}{2.5I^2}$$

The temperature difference ranges from 7° F. (3.9° C.) to 11.1° F. (6.1° C.) at a 1 A current design.

Figure 3:
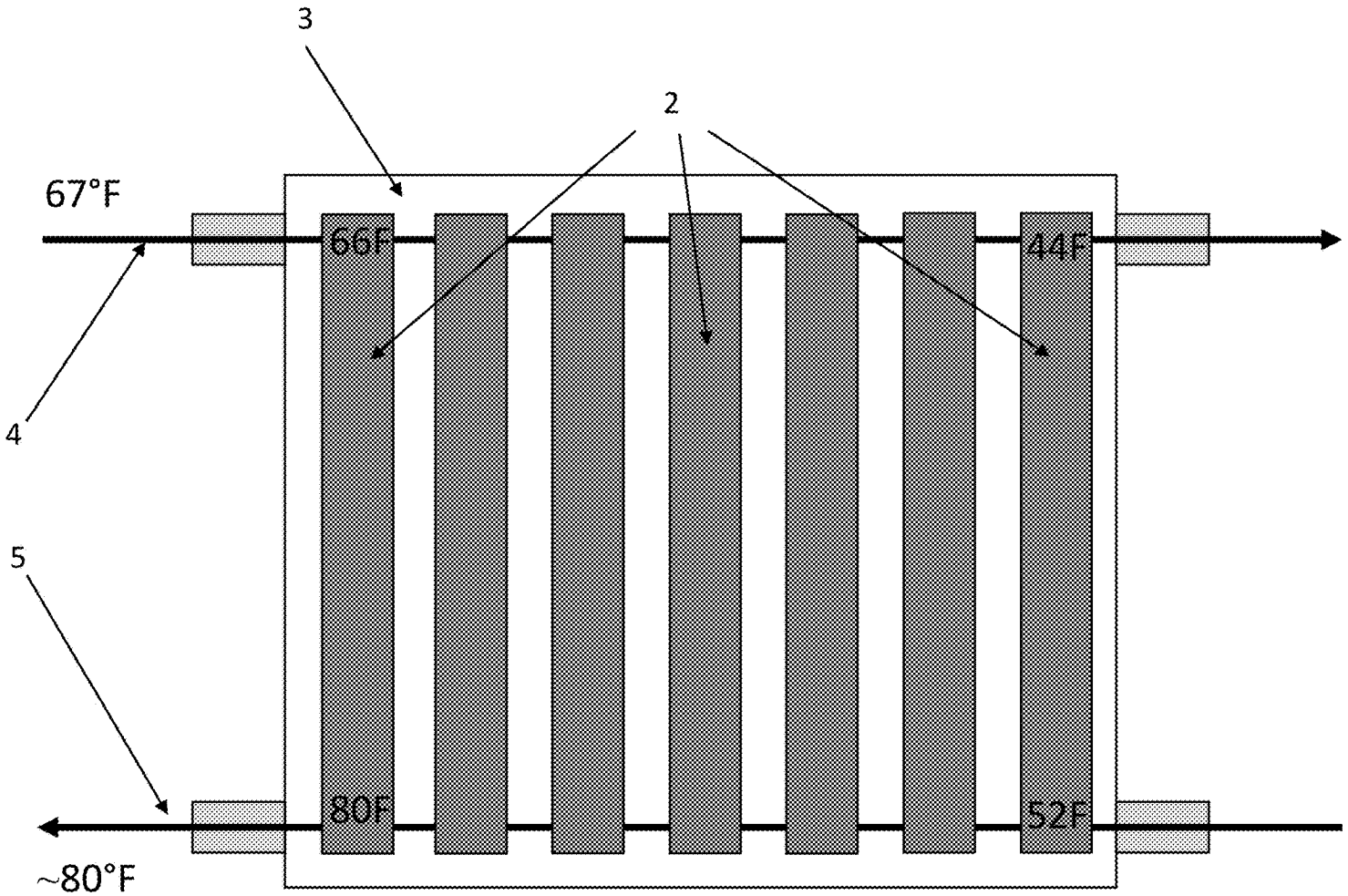
FIG. 3 depicts a schematic view of a series of TEC units sandwiched between cold plates, with resulting changes in temperature.

The cold plates 3 with TEC 2 units arranged therebetween allow for progressive cooling and heating of water streams, thereby allowing a 67° F. water supply to be cooled, for example to 44° F. for use in an air conditioning cooling coil, while at the same time warming the returning water from the cooling coil from for example 51° F. to 80° F. for use in heating or for disposing of excess heat. For example, as shown schematically (not to scale) in FIG. 3, a stack of two cold plates sandwiching a series of TECs 2 illustrates these heating/cooling effects on a water stream. The supply water 4 at 67° F. enters a cold plate at the upper left at the first TEC 2, which cools the 67° F. supply water to 66° F. while heating the 79° F. return water to 80° F., and the last TEC 2 cools the 45° F. supply water to 44° F. supply water while heating the 51° F. incoming return water to 52° F. The series of TECs thereby cools and warms water simultaneously by heat exchange with the cool cold plate on one side and the hot cold plate on the other. Each TEC in the series is capable of contributing a temperature difference, and the series of TECs shown in FIG. 3 combine to cumulatively yield desirable temperature differences output to the outflowing streams.

Figure 4:
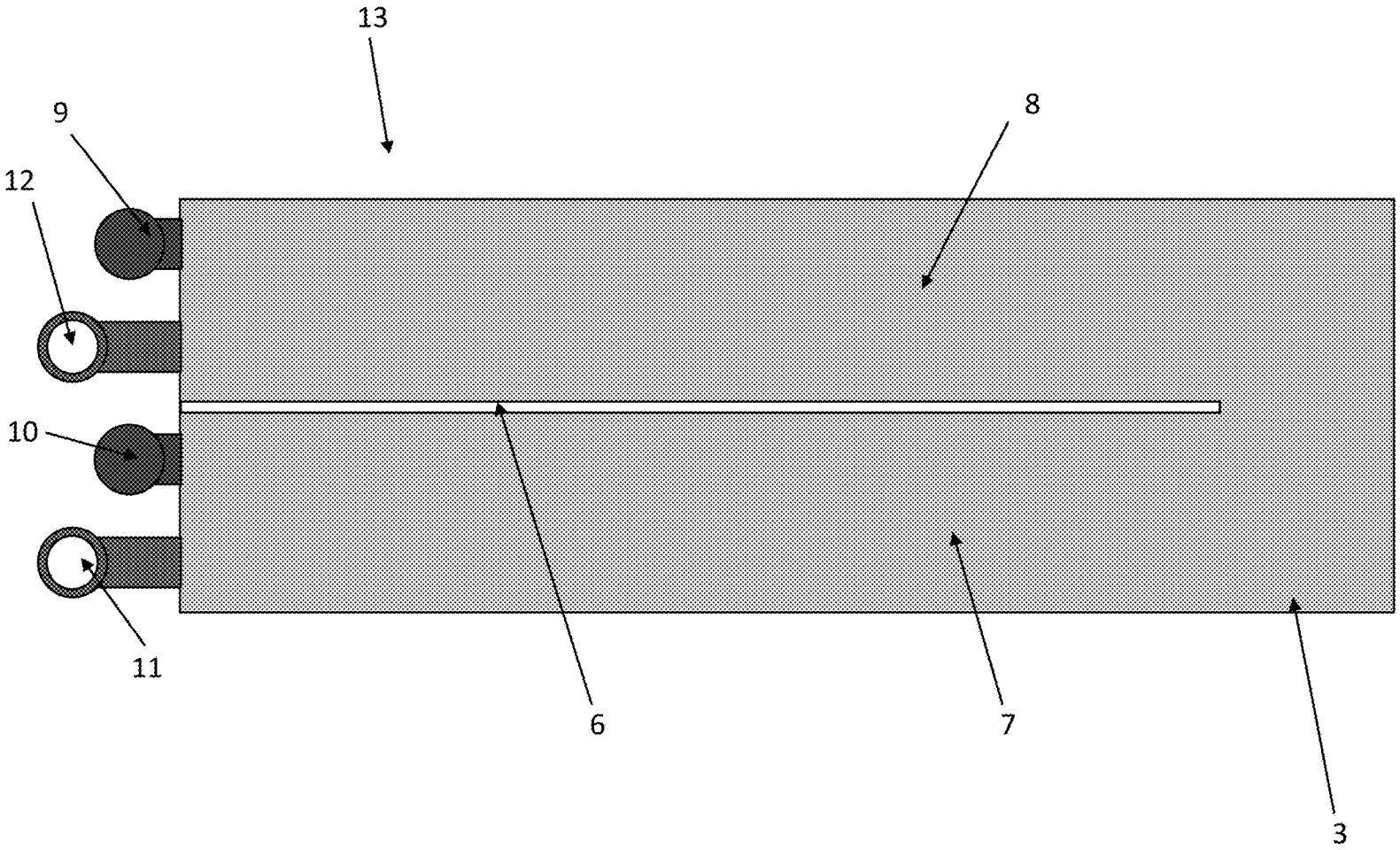
FIG. 4 depicts a perspective view of a heat pump embodiment of the invention.
Figure 5:
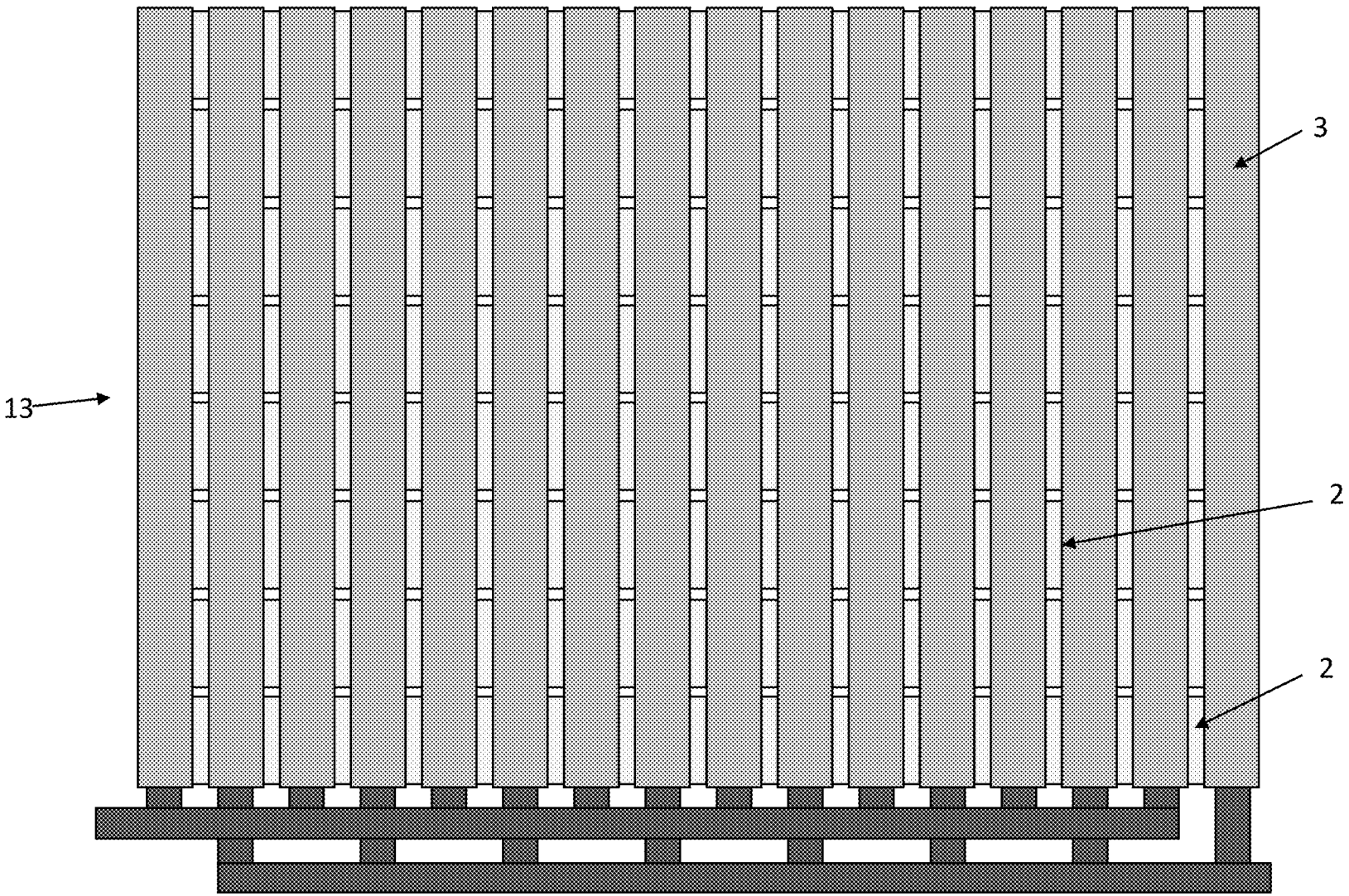
FIG. 5 depicts a perspective view of a heat pump embodiment of the invention.
Figure 6:
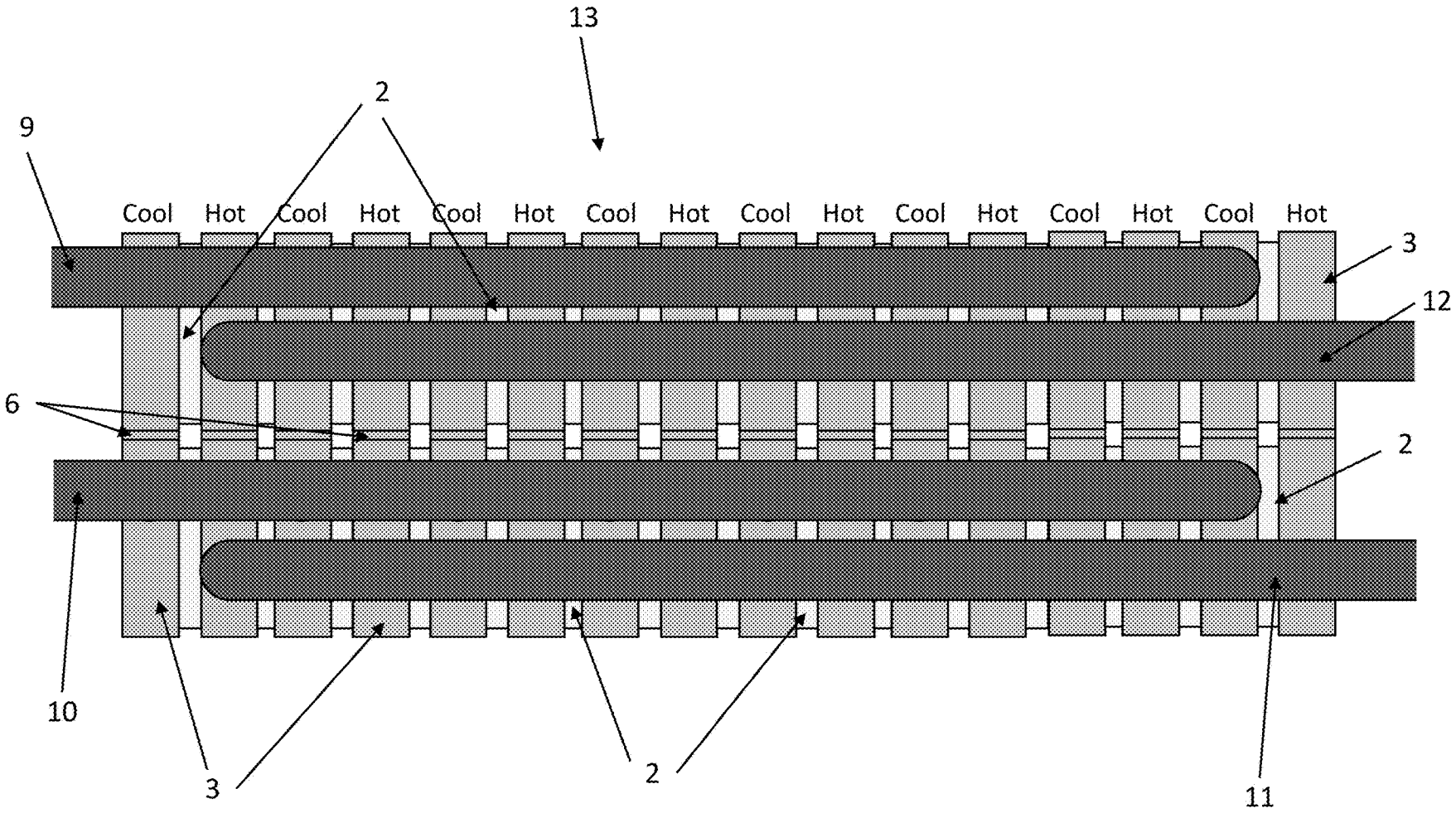
FIG. 6 depicts a perspective view of a heat pump embodiment of the invention.
Figure 7:
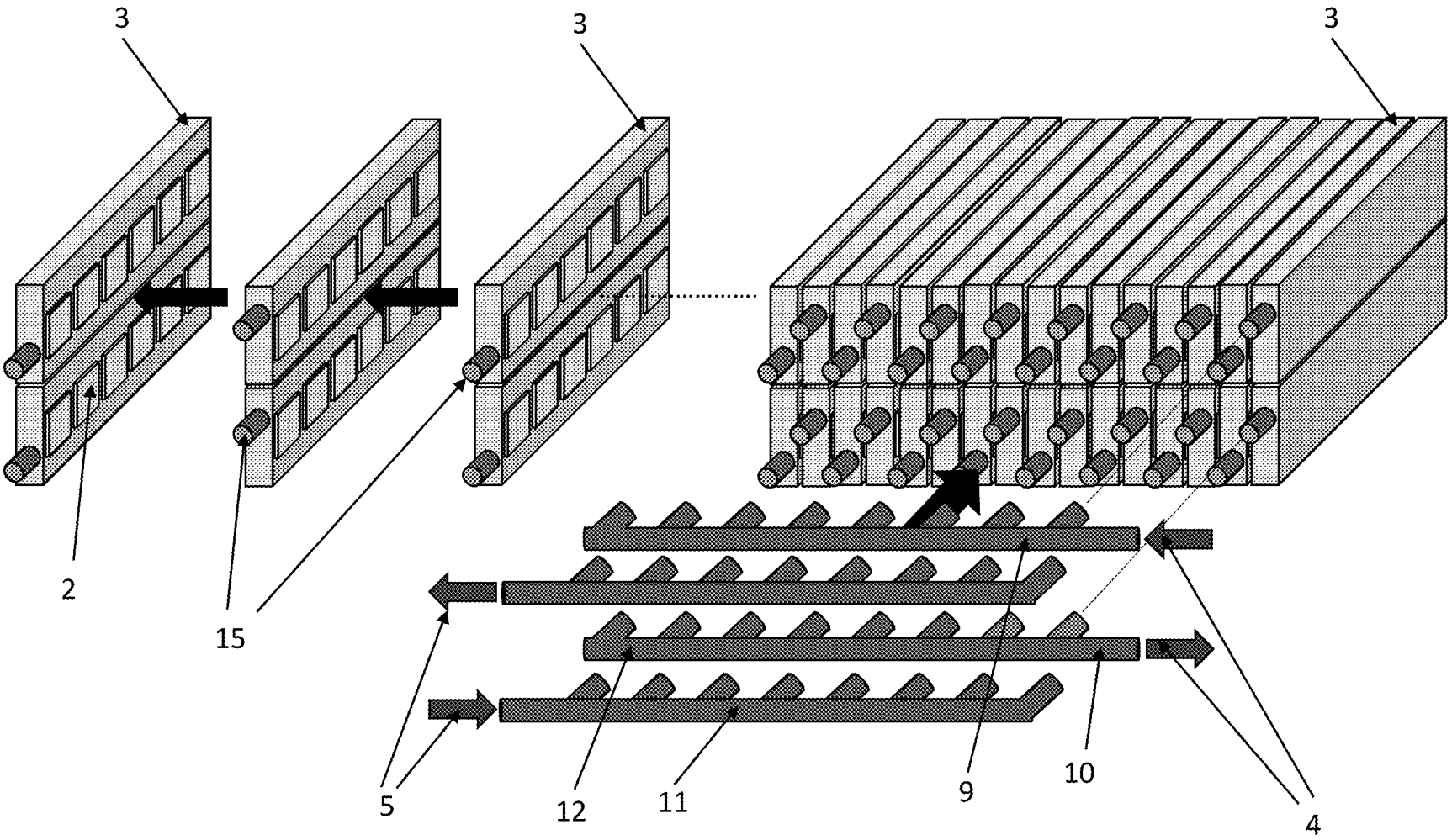
FIG. 7 depicts an exploded view of a heat pump embodiment of the invention illustrating the components of the stacked cold plates.

Such cold plates 3 may be stacked into an array allowing for progressive cooling and heating of water streams on a much larger scale, effectively generating a cascading thermoelectric heat pump 13 of the invention, as shown in the different perspectives in FIGS. 4-6 for a stack of 16 cold plates 3. FIG. 7 illustrates the design layout of such a stack, with three cold plates 3 removed from the left side allowing observation of the TECs 2 sandwiched between the cold plates 3, and the layout of the water streams passing alternately through the cold and hot plates in a staggered fashion.

The design shown in FIGS. 4-7 has TECs 2 sandwiched between cold plates 3, such that the TECs 2 are situate on both sides of each cold plate (except for the end of the stack cold plates). This design uses McMaster Carr 35035K42 cold plates 3 with dimensions of about 12 inches long by 3.5 inches wide×0.5 inches thick. As shown in FIG. 4, the cold plates 3 are modified with a slit 6 in the middle, extending from one end through the majority of the cold plate 3 toward the other end, to inhibit heat transfer from the bottom of the cold plate 7 to the top 8.

FIG. 4 illustrates a cold plate 3 at one end of a stack, in an edge-on view of the heat pump 13 with the length and width of the cold plate 3 at the right side of the stack facing toward the viewer. Conduits 9-12 for fluid streams are shown, which connect to the cold plates' 3 internal tubes 15; however, in this perspective, the viewer sees the conduits for the cold supply 4 streams for the cold plate 3 shown and also the conduit for the hot stream 5 of the next cold plate 3 in the stack, that of the next, etc., superimposed. In each of the "cool" cold plates 3, the cold supply stream 4 flows into the inflowing cool conduit 9, passes through the cold plate tubes 15 in a loop, and out the outflowing cool conduit 10. In each of the "hot" cold plates 3, the hot supply stream 5 flows into the inflowing hot conduit 11, passes through the cold plate tubes 15 in a loop, and out the outflowing hot conduit 12. The conduits (9, 10 or 11, 12) respectively of each alternate cold plate 3 in the stack are joined to each other to make a continuous stream through the stack, as further illustrated in FIGS. 5, 6, and 7.

FIG. 5 illustrates a top-down view of the heat pump 13 showing the upper edges of the cold plates 3, the TECs 2 sandwiched therebetween, and the conduits 9-12 carrying water from and to the heat pump 13. FIG. 6 illustrates a face-on view of the "front" of the heat pump 13 in which the viewer can see the stack of cold plates 3 with the slits 6 in each of the cold plates 3, the TECs 2 sandwiched between the cold plates 3, and the conduit 9-12 lines carrying the water streams. The alternate cold plates 3 are labeled "Cool" and "Hot" to show the staggered alternating structure of the stack of cold plates 3 making the heat pump 13.

FIG. 7 illustrates the construction of the heat pump 13 stack of cold plates 3. The incoming cool water stream 4 feeds and empties the conduits 9-10 feeding and emptying the cool cold plates 3 respectively, while the hot water stream 5 feeds and empties the conduits 11-12 feeding and emptying the hot cold plates 3, respectively.

Combining the views in FIGS. 4-7, the path of the cool water stream 4 through the heat pump 13 begins as it enters the inflowing cool conduit 9, enters the inflow ends of the tubes 15 of the cold plates 3, flows through the upper side 8 of each cold plate 3 around the loop defined by the slit 6 and the tube 15, back through the lower sides 7 of each cold plate 3, and finally flows out the outflow ends of the tubes 15 of the lower sides of the cold plates 3 into the outflowing cool conduit 10. Likewise, the path of the hot water stream 5 through the heat pump 13 begins as it enters the inflowing hot conduit 11, enters the inflow ends of the tubes 15 of the cold plates 3, flows through the lower side 7 of each cold plate 3 around the loop defined by the slit 6 and the tube 15, back through the upper sides 8 of each cold plate 3, and finally flows out the outflow ends of the tubes 15 of the lower sides of the cold plates 3 into the outflowing hot conduit 10. During the water streams' journeys through the stack of cold plates 3, the streams are cooled and warmed, respectively, by virtue of heat exchange with the cold and hot sides of the cold plates 3 which were cooled and heated by the sandwiched TECs 2.

A model heat pump 13 of the design was constructed using the McMaster cold plates described above, each of which accommodate 32 Marlow TECs (16 per side) on each cool cold plate. Table 1 provides a comparison of the results for different operating and design conditions with estimates of performance, weight, volume, and power consumption.

The coefficient of performance of the system (COP) is the ratio of heat absorbed in the cooling coil ($Q_{cc}$) to the power (P) utilized to reduce the chilled water from 67° F. to 44° F. N is the number of TECs per ton. As the number of TECs increase, the system weight and volume increase, and the total system power and COP decrease.

$$COP = \frac{Q_{CC}}{P} = \frac{3500W}{2.5I^2N}$$

TABLE 1

| | | Per 1 $Ton_R$ | | |
|---|---|---|---|---|
| Power (Watts) | Current (Amps) | Volume (cubic inches/ton) | Weight (lb/1 ton) | COP |
| 664 | 0.5 | 4771 | 160 | 5.3 |
| 945 | 0.75 | 2822 | 105 | 4 |
| 1099 | 1 | 2016 | 80 | 3.2 |
| 1599 | 1.5 | 1277 | 60 | 2.2 |

Figure 8:
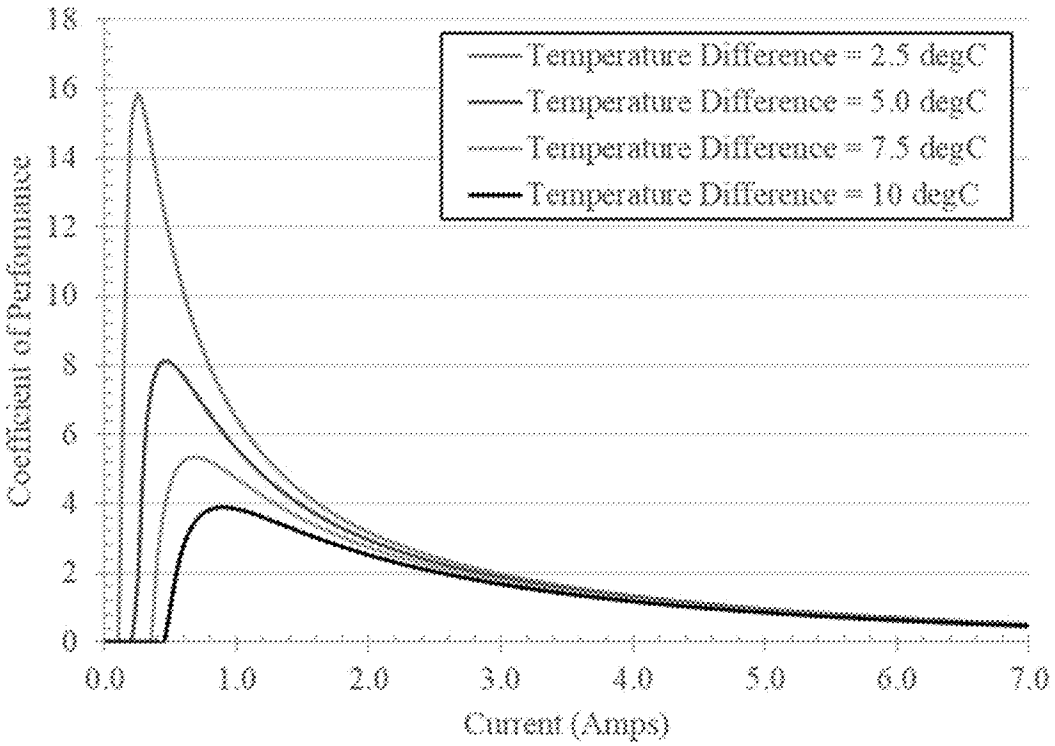
FIG. 8 shows the relationship between the coefficient of performance and the applied current for four different temperature differences.

The COP is an indicator of the amount of heat being transferred compared to the amount of power being put in. A COP of 5, for example, means 5 kW of heat are transferred from low to higher temperature for every 1 kW of power input to the system. FIG. 8 shows the how the relationship between the COP for TEC-based heat pumps of the invention vary with current and temperature differences.

Figure 9:
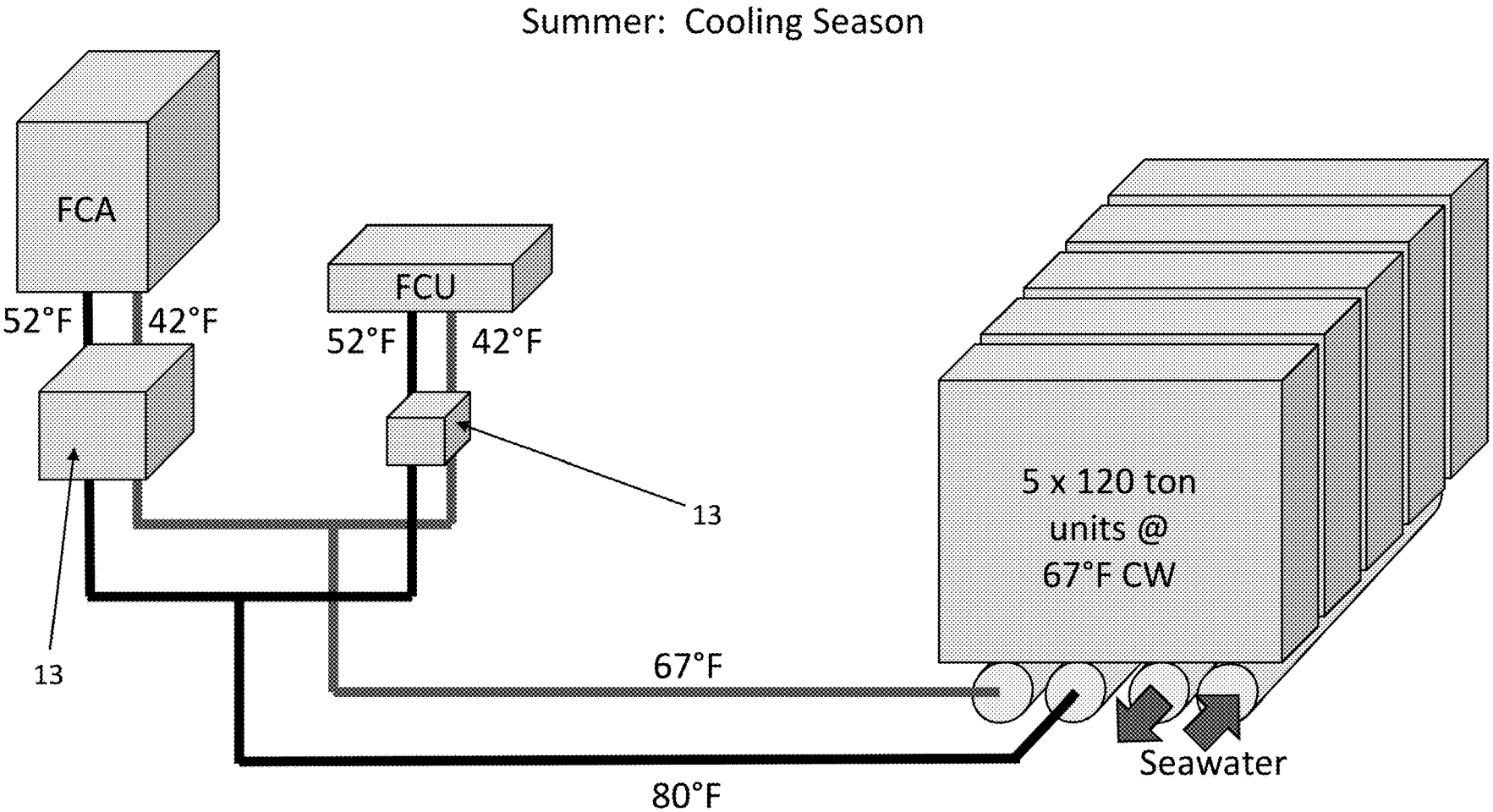
FIG. 9 depicts a schematic model for using embodiments of the small heat pumps of the invention when cooling is desired, such as during the summer.
Figure 10:
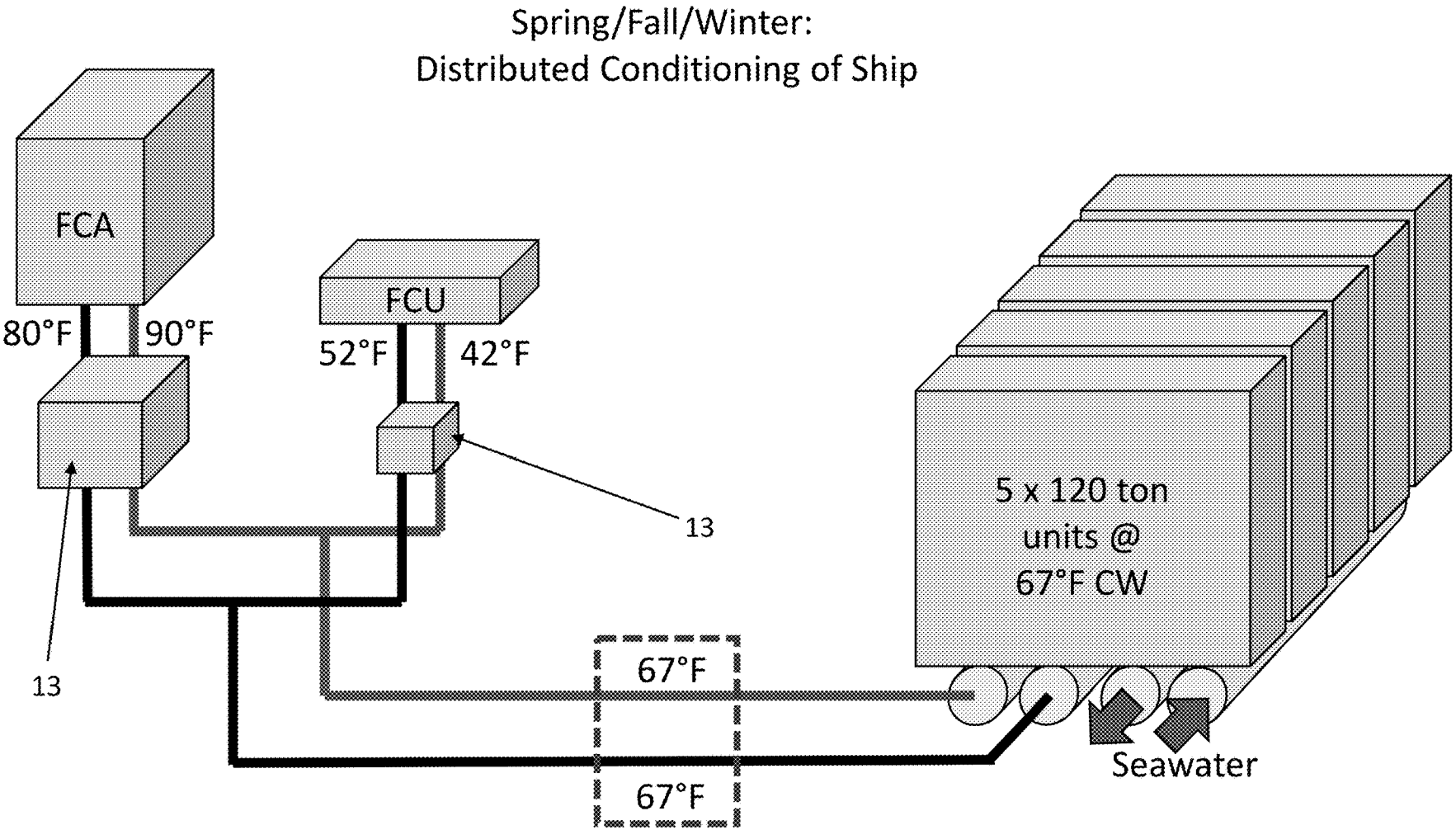
FIG. 10 depicts a schematic model for using embodiments of the small heat pumps of the invention when heating is desired, such as during the fall, winter, and spring.

FIG. 9 illustrates use of the invention during the summer when cooling air conditioning is desired. FIG. 10 illustrates use of the invention during the fall, winter, and spring when distributed conditioning is needed.

While future efforts will undoubtedly expand the SWAP of the TEC-based heat hump of the invention, it is plainly evident that the TEC-based solution is not only viable but superior in many ways to existing chillers. Importantly, the TEC module mean time before failure (MTBF) is greater than 250,000 hours (28.5 years). This is the typical lifetime of a naval vessel, suggesting that such TEC chillers will not require costly and time-consuming service and maintenance. Conventional vapor compression chilling systems, on the other hand, require regular maintenance for continued operation.

While a standard heat pump may appear to be more energy efficient than the heat pump of the invention, standard heat pumps have several noteworthy disadvantages including noise hazards, and refrigerant hazards that can cause serious injury for sailors in the confined spaces of a ship. The heat pump of the invention does reduce the electrical power used for heating and cooling on a Navy ship. With no moving parts, the heat pump of the invention also has an advantage in that it produces no noise.

Heat pumps of the invention can heat water from a 67° F. supply to as high as 95° F., and can chill water from a 67° F. supply to as low as 40° F. The heat pumps of the invention are far smaller in size than conventional heat pumps, and can be provisioned at the desired points of service, for example, where water enters HVAC equipment. The heat pumps of the invention is also useful in other applications. For example, they may be used for replenishment air entry into buildings or vessels, without the hazards posed by refrigerant-based heat pumps.

Those of skill in the art will readily appreciate that the heat pumps of the invention may be constructed using a variety of TEC modules and a variety of cold plates depending on the user's particular application and particular desired results. Likewise, those of skill in the art will readily appreciate that a variety of materials may be used for conduits, connections, and the like.

The present invention is not to be limited in scope by the specific embodiments described above, which are intended as illustrations of aspects of the invention. Functionally equivalent methods and components are within the scope of the invention. Various modifications of the invention, in addition to those shown and described herein, will be readily apparent to those skilled in the art from the foregoing description. Such modifications are intended to fall within the scope of the appended claims. All cited documents are incorporated herein by reference.

What is claimed is:

1. A cascading thermoelectric heat pump comprising a stack of at least four thermally conductive cold plates, each cold plate in the stack being alternatingly a cool cold plate or a hot cold plate, the cold plates having at least two channels and at least one tube for carrying fluid looping through the channels, the tube having an inflow end and an outflow end;

a plurality of electrically connected thermoelectric coolers situate between each respective pair of cold plates;

an inflowing cool conduit connected to the inflow ends of the tubes of the cool cold plates and an outflowing cool conduit connected to the outflow ends of the tubes in the cool cold plates;

an inflowing hot conduit connected to the inflow ends of the tubes in the hot cold plates and an outflowing hot conduit connected to the outflow ends of the tubes in the hot cold plates;

wherein each of the cold plates has an upper side with an upper channel and a lower side with a lower channel; and the tube enters the cold plate through the upper channel in the upper side, loops around to return anti-parallel in the lower channel in the lower side, whence it exits the cold plate; and wherein, when electricity is supplied to the thermoelectric coolers, a cool supply stream of fluid supplied to the inflowing cool conduit is cooled by passage through the stack of cold plates, and a hot supply stream of fluid supplied to the inflowing hot conduit is heated by passage through the stack of cold plates.

2. The cascading thermoelectric heat pump of claim 1, wherein the cold plates have a slit capable of inhibiting heat exchange between the upper side and the lower side of the cold plates, the slit being parallel to the channels and the tube, the slit extending from a proximal edge of the cold plates where the tubes enter and exit, and the slit extending at least halfway through to a distal edge of the cold plate.

3. The cascading thermoelectric heat pump of claim 1, wherein the plurality of thermoelectric coolers are arranged in two rows, an upper row on the upper sides of the cold plates and a lower row on the lower sides of the cold plates.

4. The cascading thermoelectric heat pump of claim 3, wherein the upper row and the lower row each comprise at least eight thermoelectric coolers.

5. The cascading thermoelectric heat pump of claim 3, wherein the upper row and the lower row each comprise at least twelve thermoelectric coolers.

6. The cascading thermoelectric heat pump of claim 3, wherein the upper row and the lower row each comprise at least sixteen thermoelectric coolers.

7. The cascading thermoelectric heat pump of claim 1, wherein the cold plates are McMaster Carr 35035K42 cold plates having copper tubes, and the thermoelectric coolers are Marlow TR060-6.5-040 thermoelectric coolers.

* * * * *